US005332241A

United States Patent [19]

Rho

[11] Patent Number: 5,332,241

[45] Date of Patent: Jul. 26, 1994

[54] BABY'S HIGH-CHAIR WITH FOLDABLE STRUCTURE

[76] Inventor: Angelo Rho, Via IV Novembre 10/D - 24060 Telgate, (Province of Bergamo), Italy

[21] Appl. No.: 909,498

[22] Filed: Jul. 6, 1992

Related U.S. Application Data

[62] Division of Ser. No. 491,917, Mar. 12, 1990, Pat. No. 5,165,755.

[30] Foreign Application Priority Data

Mar. 15, 1989 [IT] Italy ..... 19781 A/89
Jan. 19, 1990 [IT] Italy ..... 19099 A/90

[51] Int. Cl.[5] ..... A47C 3/20

[52] U.S. Cl. ..... 297/344.14; 297/344.1; 297/423.28; 248/408

[58] Field of Search ..... 297/345, 19, 30, 344, 297/250, 346, 338, 25, 56, 344.1, 344.12, 344.13, 344.14, 250.1, 256.16, 423.28, 423.26; 248/407, 408, 409, 157, 327, 188.5

[56] References Cited

U.S. PATENT DOCUMENTS

| | | | |
|---|---|---|---|
| 1,299,827 | 4/1919 | Edwards | 297/345 X |
| 1,326,363 | 12/1919 | Michelin | 248/407 |
| 2,517,004 | 8/1950 | Little et al. | 297/30 |
| 2,767,774 | 10/1956 | Derby | 297/345 X |
| 2,777,503 | 1/1957 | Grace | 297/56 X |
| 3,377,966 | 4/1968 | Bates et al. | 297/345 X |
| 3,542,419 | 11/1970 | Spinola | 297/345 X |
| 3,572,827 | 3/1971 | Merelis | 297/250 X |
| 4,447,087 | 5/1984 | Massonnet | 297/345 X |
| 4,722,570 | 2/1988 | Bertoli | 297/345 |
| 4,861,100 | 8/1989 | Baccaro | 297/56 X |

FOREIGN PATENT DOCUMENTS

| | | | |
|---|---|---|---|
| 0387764 | 9/1990 | European Pat. Off. | 297/345 |
| 2177907 | 2/1987 | United Kingdom | 297/345 |

*Primary Examiner*—Kenneth J. Dorner
*Assistant Examiner*—Milton Nelson, Jr.
*Attorney, Agent, or Firm*—Guido Modiano; Albert Josif; Daniel O'Byrne

[57] ABSTRACT

The high-chair has a base stand constituted by two mutually foldable arms. A chair-like body is slidably supported on one of the arms and has a back which is rigidly associated with guiding elements for sliding on the related arm. A seat is hinged to the back and is in turn hinged to a foot-rest which can be folded, together with the seat, toward the back. Elements are provided for releasably locking the chair body onto the related arm and allow a continuous sliding of the chair body on the arm for movement in the direction of lifting the chair body and, in discrete and successive portions, for movement in the direction of lowering the chair body.

12 Claims, 6 Drawing Sheets

BABY'S HIGH-CHAIR WITH FOLDABLE STRUCTURE

This is a division of application Ser. No. 07/491,917 filed Mar. 12, 1990 and now U.S. Pat. No. 5,165,755.

BACKGROUND OF THE INVENTION

The present invention relates to a baby's high-chair with reduced-bulk foldable structure.

As is known, various kinds of baby's high-chairs are currently commercially available and, in their most common embodiment, are constituted by a supporting base or frame to which a chair is connected, possibly with means which allow to adjust the positioning height of said chair.

In known solutions, in some cases the frame can be folded, thus allowing to reduce its bulk, whereas the chair maintains its own configuration, with the disadvantage of creating considerable bulk during storage and transport.

This fact is all the more negative if one takes into account that high-chairs are structures with a relatively light weight, so that the considerable packaging volumes significantly affect transportation costs since they do not allow to fully employ their potentialities.

Another disadvantage is furthermore constituted by the fact that in high-chairs with the possibility of adjusting the height of the chair's position in practice there are no safety devices, so that it is possible that the chair may lower accidentally, even with a rapid fall, with consequent risks for the child.

In known solutions, the means for adjusting the height position of the chair are furthermore generally difficult to operate and are such as to make adaptation operations complicated.

SUMMARY OF THE INVENTION

The aim of the invention is indeed to eliminate the above described disadvantages by providing a baby's high-chair with foldable structure which has, in folded position, considerably reduced and flattened dimensions, so as to allow the optimum use of loading volumes during transport.

Within the scope of the above described aim, a particular object of the invention is to provide a baby's high-chair which, when it is not used by the user, can be folded with rapid and simple maneuvers, reducing to a bulk which does not constitute a hindrance of any sort for the user.

Another object of the present invention is to provide a baby's high-chair wherein the chair is adjustable in height in a simple manner, with the assurance of not being able to cause, even accidentally, the rapid descent of the chair itself.

A further object of the present invention is to provide a baby's high-chair which can be obtained with simple means, is easy to manufacture and is furthermore competitive from a merely economical point of view.

The above described aim, as well as the objects mentioned and others which will become apparent hereinafter, are achieved by a baby's high-chair with reduced-bulk foldable structure, according to the invention, characterized in that it comprises a base stand constituted by two mutually foldable arms, a chair body being slidably supported on one of said arms, said chair body having a back which is rigidly associated with the guiding elements sliding on said arm, a seat being hinged to said back, said seat being in turn hinged to a foot-rest which can be folded toward said back, means being furthermore provided for releasably locking said chair body on said arm, said means being adapted to allow a continuous sliding of said chair body on said arm, for movement in the direction of lifting said chair body, and in discrete and successive portions for movement in the direction of lowering said chair body.

BRIEF DESCRIPTION OF THE DRAWINGS

Further characteristics and advantages of the invention will become apparent from the description of a preferred but not exclusive embodiment of a baby's high-chair with foldable structure, illustrated only by way of non-limitative example in the accompanying drawings, wherein.

DESCRIPTION OF THE PREFERRED EMBODIMENTS

Figure 1:
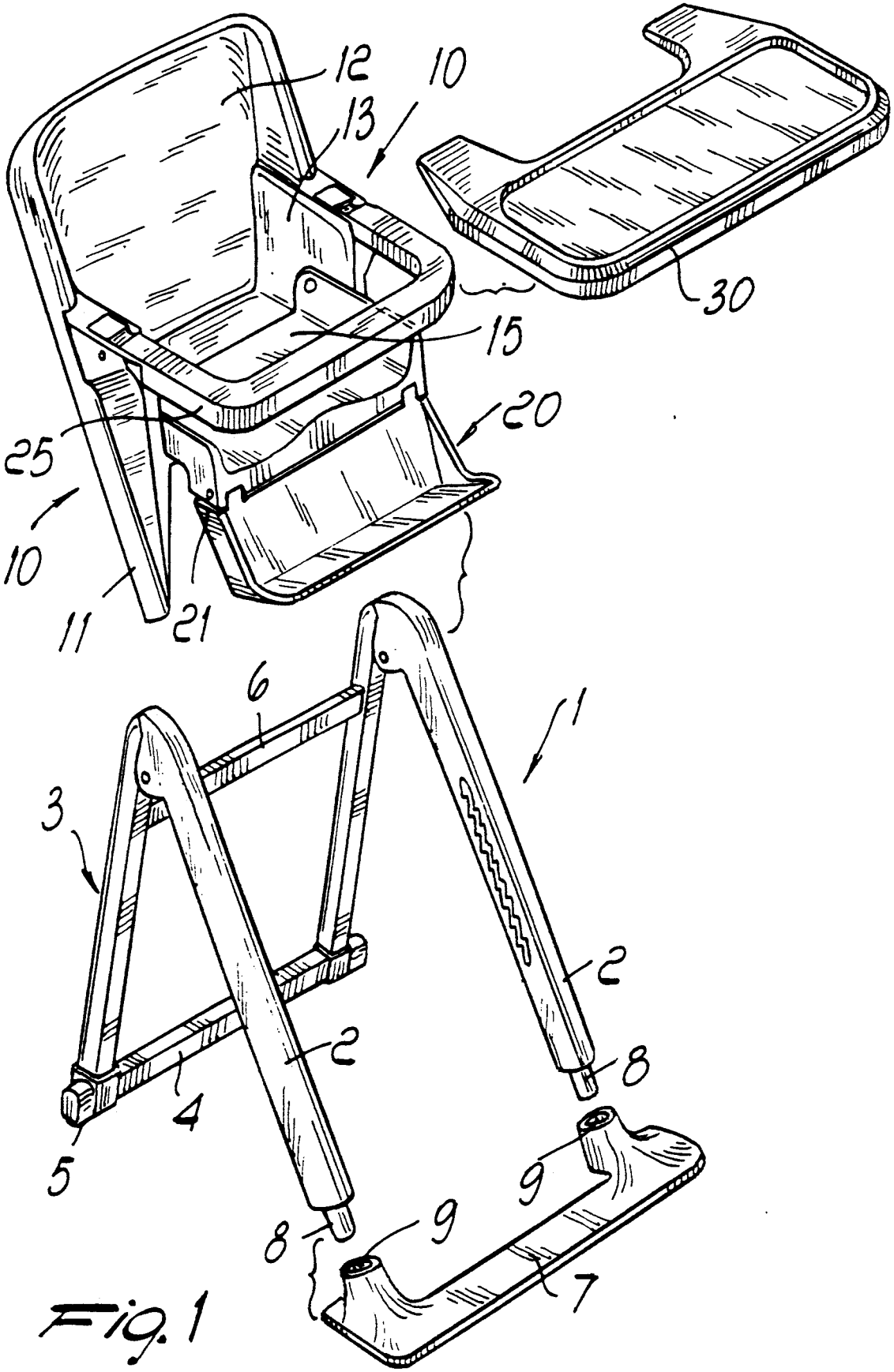
FIG. 1 is a schematic exploded perspective view of the high-chair according to the invention.

With reference to FIGS. 1 to 12, the baby's high-chair with reduced-bulk foldable structure, according to the invention, comprises a base stand, generally indicated the reference numeral 1, which is constituted by a front arm and by a rear arm 3 which are mutually pivoted at the upper vertex.

The rear arm 3 has a lower removable crosspiece 4 which is possibly provided with castors 5 and an upper connecting crosspiece 6.

At its lower end, the front arm 2 is removably insertable in a resting crosspiece 7 which is removable to further reduce bulk during transport, as will become apparent hereinafter. Pins 8, arranged at the ends of the arm 2 and insertable by pressure in cavities 9 defined by the crosspiece 7, are provided in order to couple said crosspiece 7.

A chair body, generally indicated by the reference numeral 10, is slidably associable with an arm of said stand 1 and preferably at the front arm 2.

Said chair body has lateral uprights 11 which define guiding elements which partially embrace the arms 2, consequently acting also as an element for engagement between the chair body and the arm 2.

The chair body 10 defines a back 12 which is rigidly associated with the uprights 11 and is rigidly connected to side walls 13 which are arranged laterally, at least for a portion, to a seat 15 which is pivoted to the back and can be folded so as to become superimposed on the back 12.

In order to perform the abutment for the positioning of the seat 15 during use, said seat 15 is provided with a transverse tab 17 which inserts in abutment against a transverse recess 18 defined by the chair body at the seat coupling region.

A precise abutment for the positioning of the seat during use is thus provided.

A foot-rest, generally indicated by the reference numeral 20, is pivoted at the front end of the seat 15 and has, in its pivoting region, an abutment 21 for positioning during use; said foot-rest can be rotated upward so that it can be superimposed on the back when the seat is folded.

A resting crosspiece, generally indicated by the reference numeral 25, is provided at the upper portion of the sides and is arranged above the seat 15; said crosspiece is closed so as to provide a child retention barrier.

Figure 2:
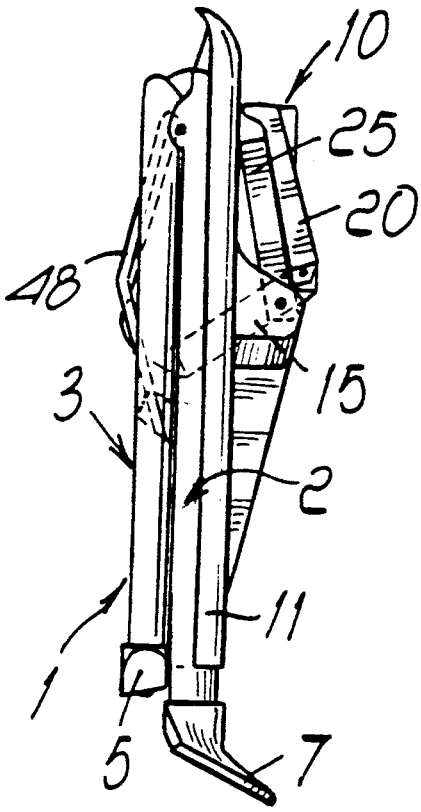
FIG. 2 is a side view of the high-chair in folded position.
Figure 3:
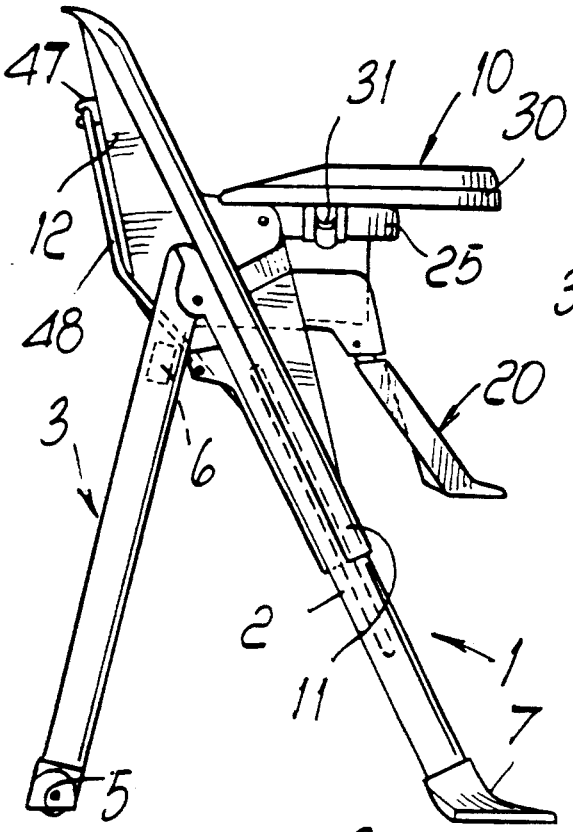
FIG. 3 is a lateral elevation view of the high-chair with the chair in raised position.
Figure 4:
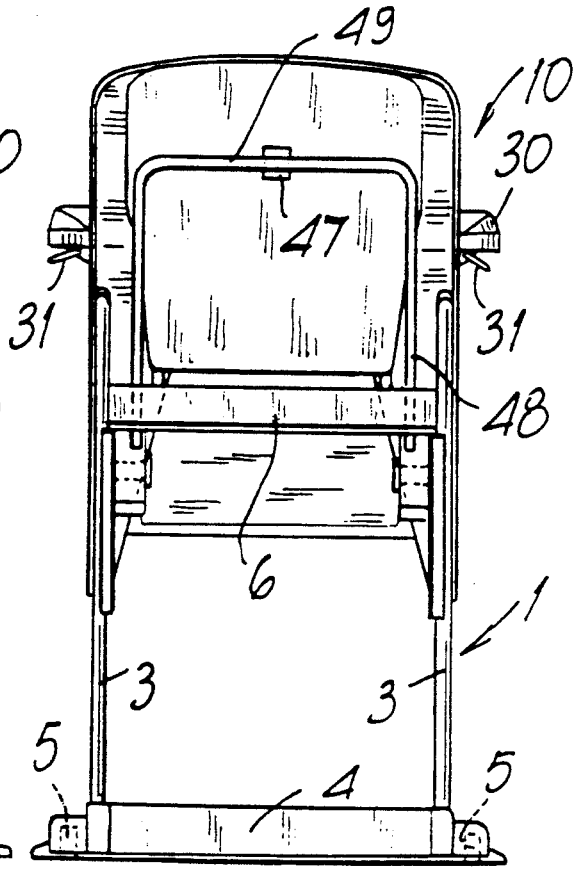
FIG. 4 is a rear elevation view of the high-chair with the chair in raised position.
Figure 6:
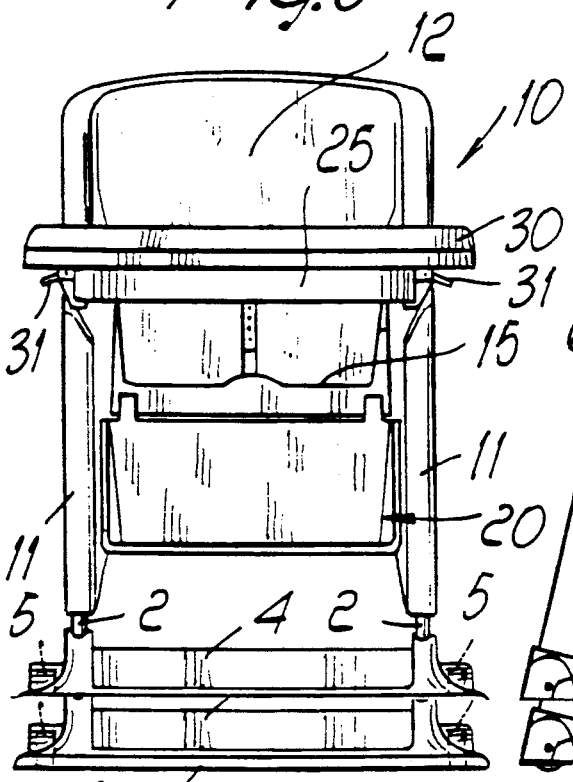
FIG. 6 is a front elevation view of the high-chair with the chair in lowered position.
Figure 5:
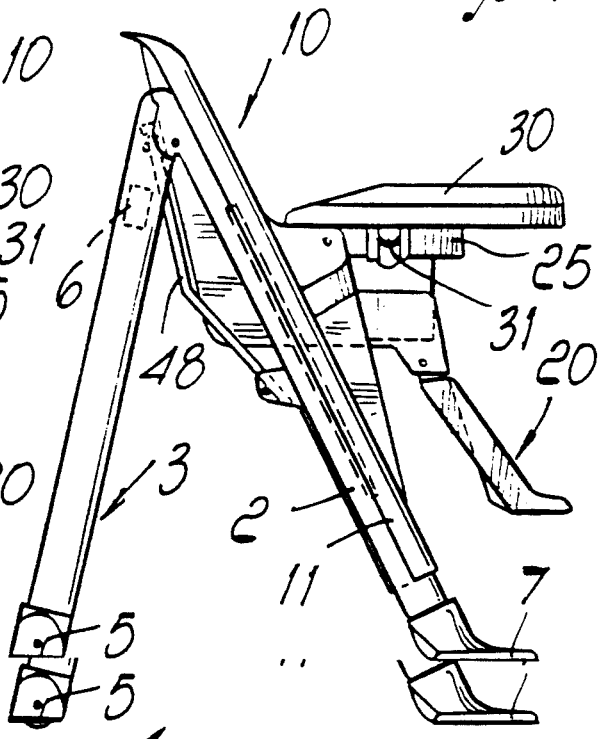
FIG. 5 is a lateral elevation view of the high-chair with the chair in lowered position.
Figure 7:
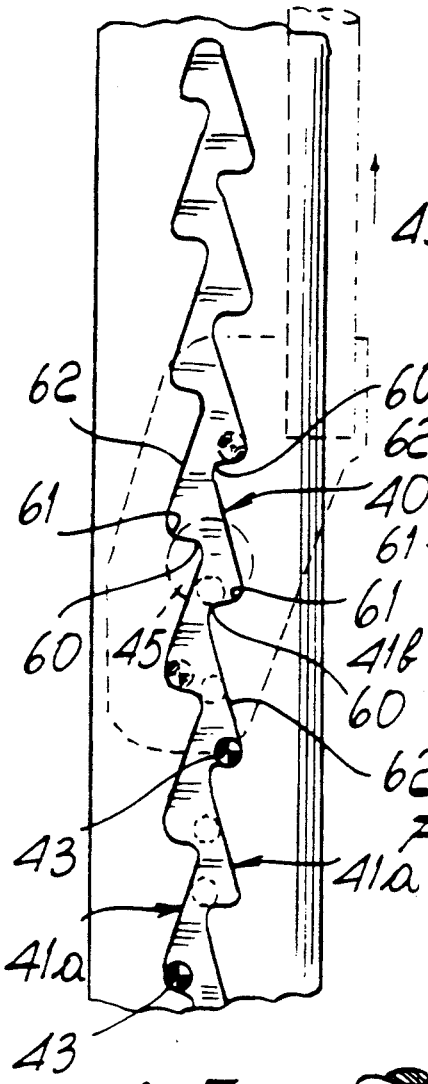
FIG. 7 is a schematic view of the guiding track the locking means, with the positions during the step movement in the direction of lifting the chair indicated in broken lines.
Figure 8:
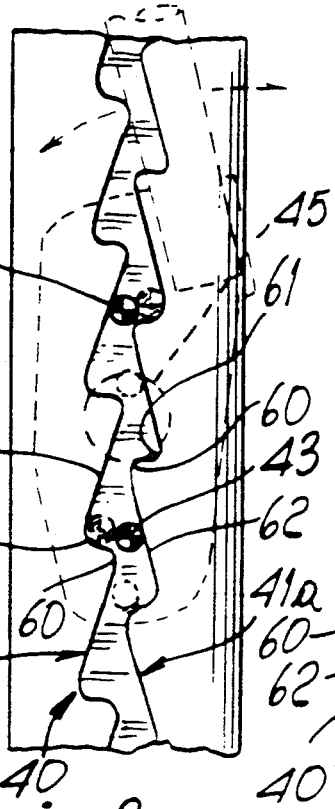
FIG. 8 is a portion of the guiding track, illustrating the step of stepwise lowering of the chair.
Figure 9:
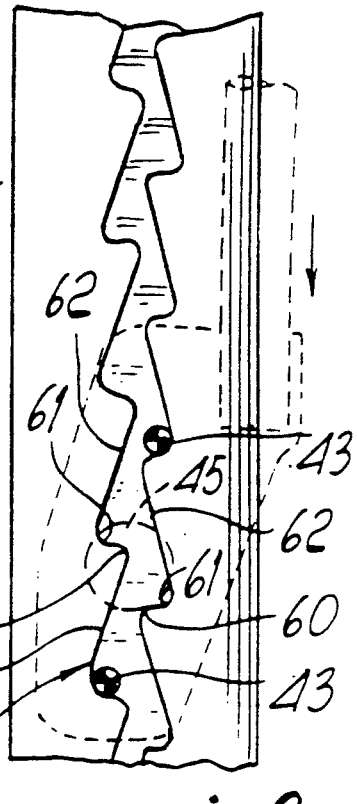
FIG. 9 is a view of the portion of the guiding track with the pins located in locking position.
Figure 12:
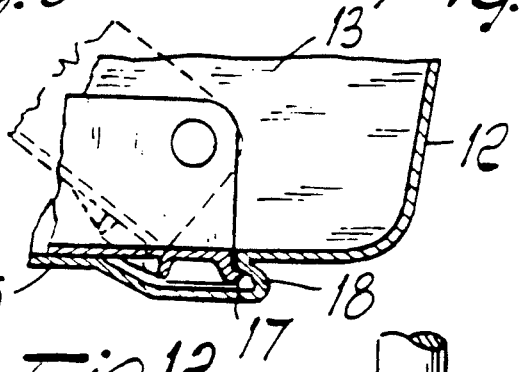
FIG. 12 is a transverse sectional view of the pivoting region between the back and the seat.
Figure 10:
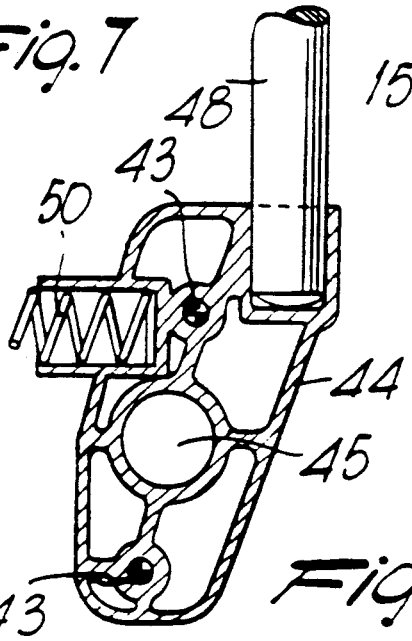
FIG. 10 is a sectional view of the means for actuating the locking means.
Figure 11:
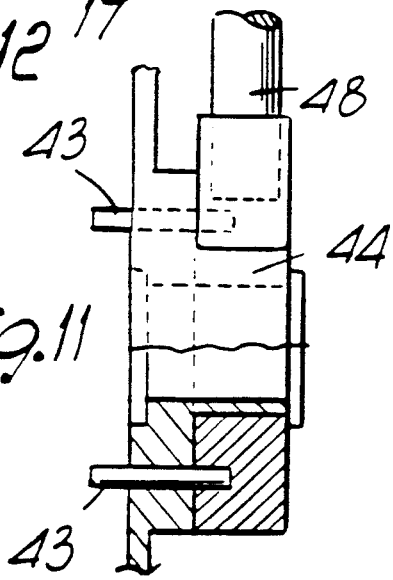
FIG. 11 is a partially sectional side view of the means for actuating the locking means.
Figure 13:
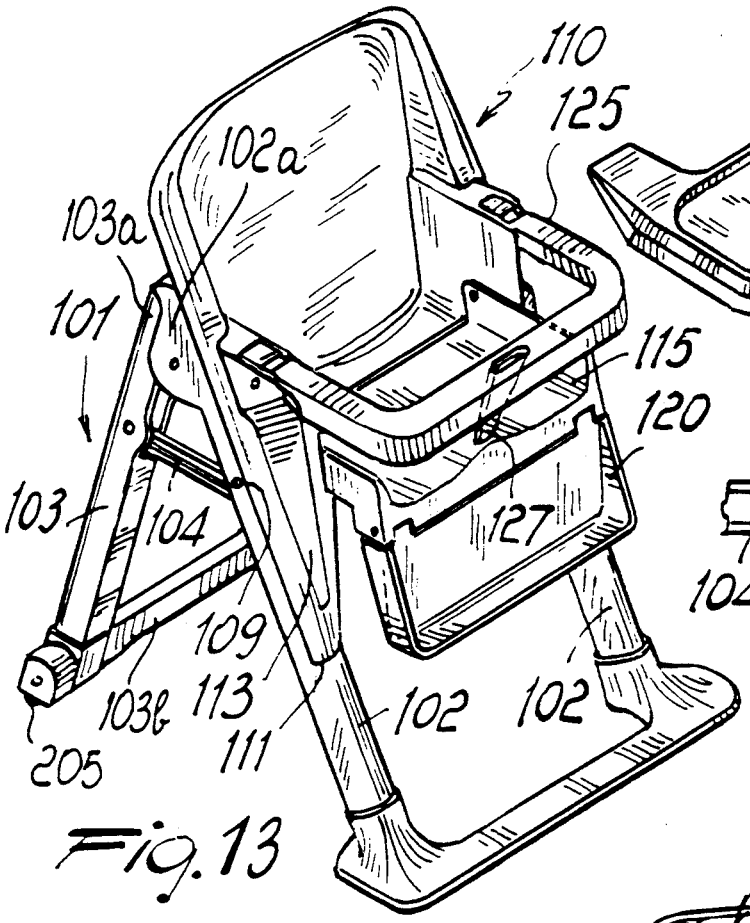
FIG. 13 is a schematic perspective view of a different embodiment of the baby's high-chair in lowered position with the table in exploded position.
Figure 16:
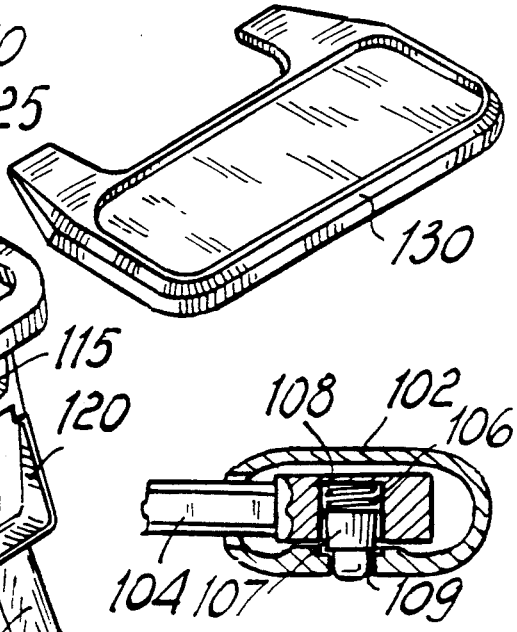
FIG. 16 is a sectional view of the means for fixing one end of said connecting rod to an arm of the stand.
Figure 15:
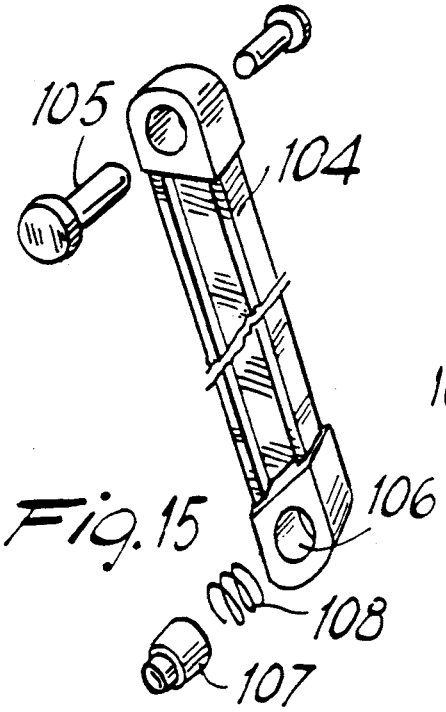
FIG. 15 is an exploded perspective view of the connecting rod of the stand arms.
Figure 14:
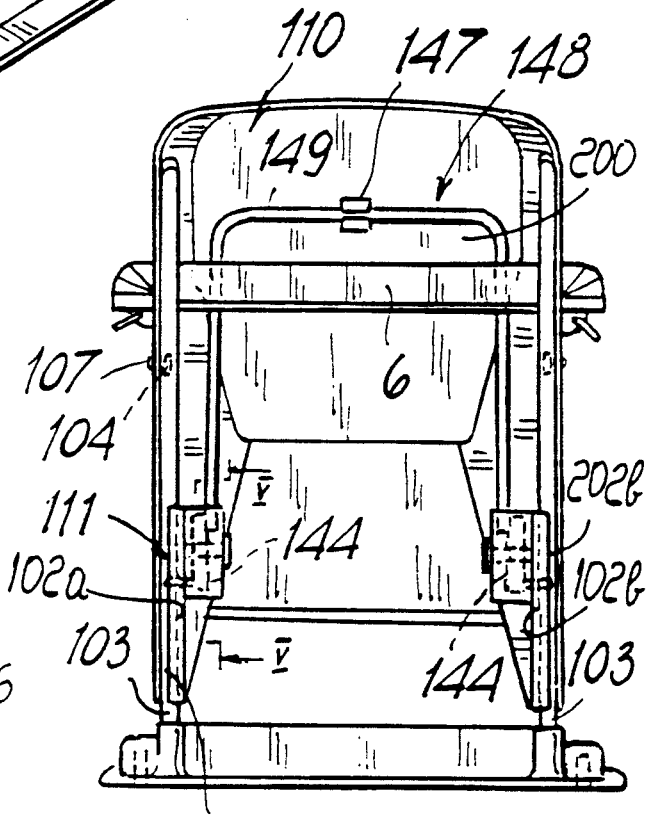
FIG. 14 is a rear elevation view of the high-chair.

The resting crosspiece 25 is also foldable against the back when not in use, and is located, as indicated in FIG. 2, below the foot-rest, which is also folded.

A small ledge 30 provided with clamps 31 for removable coupling to the resting crosspiece 25 is removably applicable thereto.

The chair body, as previously mentioned, is slidable on the arm 2, and releasable locking means are provided to position said chair body.

Said means are constituted by a guiding track 40 provided on the inner faces of the portions which constitute the front arm. Said guiding track 40, as better shown in FIGS. 7 to 9, has edges, indicated by 41*a* and 41*b*, which have a saw-tooth configuration which is opposite to the peaks, which are mutually offset, so that the peak of one edge is arranged between two peaks of the opposite edge.

Two pins, indicated by 43, can be accommodated in said guiding track and extend from an actuation body 44 which is pivoted, in its middle portion 45, to the chair body.

The pins 43 are arranged symmetrically and diametrically with respect to the pivoting point 45 and their mutual distance is greater than the distance between two peaks and smaller than twice the distance between two peaks of the edges 41*a* and 41*b*, so as to be positioned in abutment against two peaks provided on the opposite edges of the guiding track 40.

The actuation body 44 is furthermore provided with a pusher spring 50 which acts against the chair body, which tends to rotate the actuation body, so as to push one pin toward one edge and the other pin toward the opposite edge.

More in detail, the edges of the guiding track have above each peak, indicated by 60, an abutment recess 61 from which an inclined guiding plane 62 extends and reaches the subsequent peak.

With this arrangement, in practice a guide is provided for sliding in the direction of raising the sear, whereas pin locking regions are provided in the direction of lowering the seat.

The actuation body 44 can be rotated by means of a U-shaped lever, indicated by 48, which is fixed, at its free ends, to the two actuation bodies 44 provided on the two portions of the front arm 2; said lever has its connecting crosspiece, indicated by 49, proximate to the upper end of the chair body, where a bracket 47 is rearwardly provided for the removable engagement of said crosspiece.

With this arrangement, in order to raise the high-chair it is sufficient to disengage the lever from the bracket and exert an upward traction of the chair body.

With this actuation, the Dins 43 assume a ratchet-like coupling with the saw-tooth edges of the guiding track 40, allowing a continuous translatory motion.

When the traction action on the chair body ceases, the pins 43 are accommodated in the recesses provided on two opposite edges, performing the locking.

In order to perform the actuation during the descent step of the chair body it is necessary to first rotate the actuation body 44 against the biasing action of the spring 50, so as to disengage the pin 43 from the recess in which it is accommodated, with the possibility of lowering it. If the lever were kept in a rotated position, the pin would be accommodated in the recess of the tooth provided on the opposite edge; if the lever is released, the pin engages the adjacent recess provided on the same edge and in any case stops the high-chair.

In order to lower the chair body it is therefore necessary to perform a series of alternate oscillations of the body 44, thus allowing the pins to overcome the various recesses defined by the peaks of the set of teeth.

It is therefore not possible for the high-chair to accidentally perform a rapid descent which might be dangerous for the child.

The described arrangement therefore allows to have an excellent assurance of safety against the rapid lowering of the high-chair, preserving the possibility of performing a rapid lifting which can be performed only by means of a traction action, since the pins alternately skip the teeth with a ratchet-like coupling.

With reference to FIGS. 13 to 19, the baby's high-chair with reduced-bulk foldable structure, according to the invention, comprises a base stand, indicated by the reference numeral 101, which is constituted by a front arm 102 having an upper end 102*a*, and by a rear arm 103 having an upper end 103*a*. The upper ends 102*a*, 103*a* of the arms 102, 103 and by a rear arm 103 are mutually pivoted at their upper vertex, the upper vertex of said arms 102, 103. The rear arm 103 has a lower crosspiece 103*b* and an upper crosspiece (not shown in drawing figure 13) which is identical to the upper crosspiece 6 provided on the rear arm 3 of the embodiment of the invention illustrated in FIGS. 1. The lower crosspiece is provided with castors or wheels 205.

In its general embodiment, said stand is similar to the one which constitutes the subject of the first embodiment of the invention.

In order to prevent the accidental closure of the stand, means are provided for its removable locking in open position; said means are constituted by a connecting rod 104 which is pivoted for example to the rear arm 103 at one of its ends by means of pivots 105 and is slidable at its other end, which is associated with the arm 102.

More in detail, the connecting rod 104 has, at its free end, a blind hole 106 in which a button 107 is accommodated and is pushed by a spring 108 to insert, in a locked position, in a hole 109 defined on the arm 102 and to slide inside said arm 102 when the stand is to be folded.

In practice, with the stand in an open position, the button 107 protrudes into the hole 109, as it is pushed by the spring 108, whereas when closure is to be performed it is sufficient to press the button 107 to retract it into the thickness of the arm 102, consequently allowing the folding of the stand's arms.

A chair body 110 is slidably supported by one arm of the stand 101, preferably at the front arm 102, and is constituted by lateral uprights 111 which are slidably coupled to the arm 102 and are shaped as described in the foregoing description of the first embodiment (FIGS. 1-2).

The uprights 111 are radiused to the sides 113 of the back 112, to which a seat 115 is pivoted; a foot-rest 120 is coupled to said seat 115 and is also pivoted. A resting crosspiece 125 is furthermore provided and is arranged above the seat 115, acting as support for the table 130.

A further characteristic is constituted by the fact that a belt 127 is provided which joins a central portion of the resting crosspiece 125 and the seat 115, so that when the crosspiece 125 is overturned the seat and the foot-rest are folded simultaneously.

Releasable locking means are provided between the chair body 110 and the supporting stand 101 and allow to position the chair body 110 at the required height.

Figures 17, 18, 19:
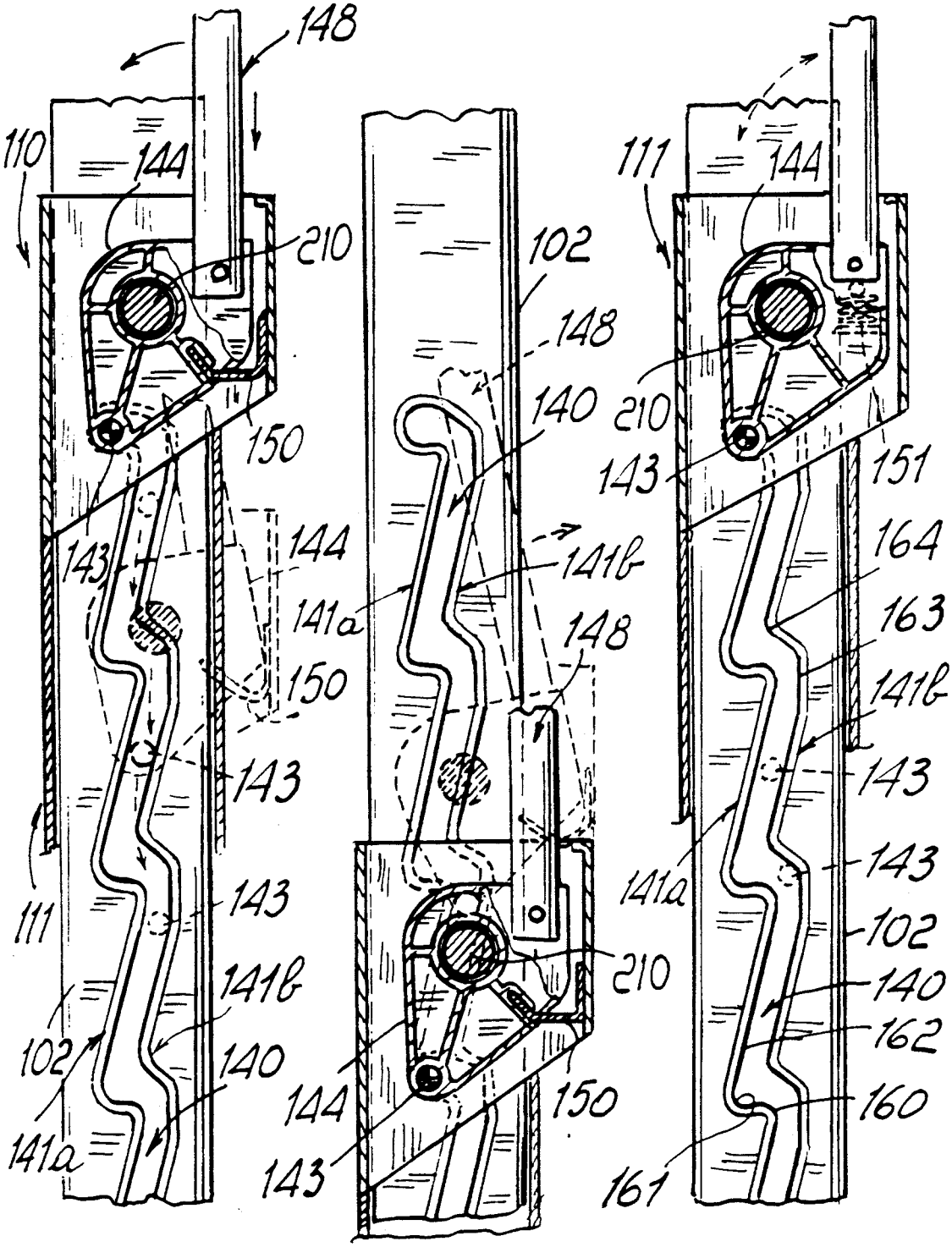
FIG. 17 is a schematic view of the releasable locking means, taken along the broken line XIV–XIV of FIG. 14.
FIG. 18 is a schematic view of the releasable locking means in lowered position.
FIG. 19 is a view of a different embodiment of the releasable locking means.

The means for releasably locking said chair body, as better shown in FIGS. 17 to 19, have a locking guide or guiding tracks, indicated by 140, which extends longitudinally on opposite inner faces 102*a*, 102*b* of portions 202*a*, 202*b* defined by the front arm 102.

Said locking guide 140 has an edge 141*a* and an edge 141*b* which are mutually, opposite and have different function, as will become apparent hereinafter. With reference to FIGS. 14 and 17-19, a pair of pivots or pins 143, which constitute locking pins, are slidably accommodatable in the guide tracks 140 provided on the arms 102, 103 and are each block or actuation body 144 associated with an oscillating which is pivoted, in its median portion, to the chair body 110 for oscillation about a pivoting point 210.

Said block 144 is connected to an actuation element constituted by a U-shaped lever 148 which is fixed, at its free ends, to the blocks 144 provided on the two front arms and has a connecting crosspiece 149 which can be arranged proximate to the upper end of the chair body, at a rear part 200 thereof, where a removable retention bracket 147 is advantageously arranged.

According to what is illustrated in FIGS. 17 and 18, elastic biasing means act between the chair body and the block 144; said means are constituted by a leaf spring 150 which, in the absence of external actuation, pushes the pivot 143 against the edge 141*a*; in the embodiment illustrated in FIG. 19, said elastic biasing means are obtained from a helical spring 151 which again acts between a portion of the chair body and the block 144.

The edge 141*a* is constituted by a path with peaks or teeth indicated by 160 which delimit a stop-seat defined by a recess or depression 161 and connect to the flanking peak by means of an inclined portion 162.

The edge 141*b* correspondingly defines a sliding guide which has recessed curves at the peak, recessed curves 163 and protruding curves 164 at said depression.

With this arrangement, when the lever 148 is not actuated, the pin 143 tends to insert in a depression, in practice locking the sliding of the chair body with respect to the stand.

When either upward or downward translatory motion is to be performed, one acts on the lever 148, which by rotating the block 144 disengages the pivot 143 from the depression 161 and places it in contact with the sliding guide constituted by the edge 141*b*.

In such conditions it is possible to translate the high-chair until the level 148 is released; when the lever 148 is released, the elastic means return the pin 143 into contact with the edge 141*a*, so that said pin inserts in the first abutment depression which it encounters, performing the locking again.

With this arrangement it is therefore possible to translate the chair body both during the ascent step and during the descent step by maintaining the actuation on the lever 148, with the assurance that when the lever is released the chair body arranges itself automatically locked position.

By virtue of the described arrangement, the high-chair cannot accidentally descend rapidly, since it stops as soon as the lever 148 is released.

From what has been described above it can thus be seen that the invention achieves the intended aim and objects and in particular the fact is stressed that: the high-chair can be folded with very reduced bulk, since in transport position the arms are arranged mutually side by side and the ledge and resting crosspiece are removed, whereas the seat and the foot-rest, together with the arm resting crosspiece, are folded against the back, consequently assuming a flat configuration which significantly reduces bulk during transport.

The invention thus conceived is susceptible to numerous modifications and variations, all of which are within the scope of the inventive concept.

All the details may furthermore be replaced with other technically equivalent elements.

In practice, though the best results have been achieved using plastic materials, the materials employed, as well as the dimensions and contingent shades, may be any according to the requirements.

I claim:

1. Baby's high chair with foldable structure, comprising;

a base stand constituted by mutually foldable arms including a front arm and a rear arm;

a chair body slideably supported on said arms;

a back rigidly connected to said chair body;

guiding elements rigidly connected to said back and slideably mounted on said arms;

a seat hinged to said back;

a foot-rest hinged to said seat and foldable toward said back;

releasable locking means for releasably locking said chair body on one of said arms, said releasable locking means being adapted to allow a continuous sliding of said chair body on said one of said arms for movement in a direction of lifting said chair body, and in discrete and successive portions for movement in a direction of lowering said chair body;

wherein said releasable locking means comprise;

opposite inner faces defined on said front arm;

guiding tracks provided on said opposite inner faces;

an actuation body oscillatably mounted on said chair body;

pins defined on said actuation body and engaging in said guiding tracks, and wherein said guiding tracks define a substantially longitudinal extension having opposite longitudinal edges, said opposite longitudinal edges having a saw-tooth shape defining peaks, said peaks of said opposite edges being arranged mutually offset, whereby a peak of one of said opposite edges is arranged between two peaks of another of said opposite edges.

2. Baby's high-chair, according to claim 1, wherein said actuation body defines a pivoting point, said pins comprising a pair of pins arranged diametrically with respect to said pivoting pins of said actuation body and insertable in said guiding tracks, recesses defined by said peaks at said opposite longitudinal edges of said guiding tracks, said pins having between one another a distance which is greater than the distance between two flanking peaks and smaller than twice the distance between said two flanking peaks so as to engage in said recesses.

3. Baby's high chair comprising;

a front arm;

a rear arm pivotally connected to said front arm;

a chair body slideably supported on said front arm;

a back connected to said chair body;

guiding elements connected to said back and slideably mounted on said arms;

a seat hinged to said back;

a foot-rest hinged to said seat and foldable toward said back;

guide means provided on said front arm;

recess means defined by said guide means;

an actuation body oscillatably mounted on said chair body;

pin means defined on said actuation body and engaging said guide means;

said pin means being continuously slideable along said guide means in a direction of lifting said chair body, said actuation body being oscillatable on said chair body for successively engaging said pin means in said recess means during movement along said guide means in a direction of lowering said chair body.

4. Baby's high-chair according to claim 3, wherein said guide means comprise a guiding track provided on opposite inner faces of said front arm, said guide track having a saw tooth configuration defining peaks, said recess means comprising abutment recesses defined between said peaks.

5. Baby's high-chair according to claim 4, further comprising an inclined guiding plane extending from each one of said abutment recesses to a successive one of said peaks.

6. Baby's high-chair according to claim 3, wherein two actuation bodies are oscillatably mounted on said chair body, said two actuation bodies being interconnected by a U-shaped lever having a crosspiece, said chair body having connected thereto a bracket, said crosspiece being releasable engageable with said bracket.

7. Baby's high-chair according to claim 3, further comprising a resting crosspiece, cavities defined in said resting crosspiece, end pins defined on said front arm and being releasably insertable into said cavities.

8. Baby's high-chair according to claim 3, wherein said chair body further comprises lateral uprights partially embracing said front arm, said back being connected to said lateral uprights, a seat pivotally connected to and superimposable on said back, and side walls connected to said uprights and arranged laterally with respect to said seat.

9. Baby's high-chair according to claim 3, wherein said seat has a transverse tab, and wherein said chair body defines a seat coupling region, said transverse tab abutting said seat coupling region.

10. Baby's high-chair according to claim 3, further comprising a resting crosspiece pivotally connected to said sides and foldable against said back beneath said foot rest.

11. Baby's high-chair according to claim 3, wherein said guide means comprise guiding tracks defining a substantially longitudinal extension and having opposite longitudinal edges, said opposite longitudinal edges having a saw-tooth shape defining peaks, said peaks of said opposite edges being arranged mutually offset, whereby a peak of one of said opposite edges is arranged between two peaks of another of said opposite edges.

12. Baby's high-chair according to claim 11, wherein said actuation body defines a pivoting point, said pin means comprising a pair of pins arranged diametrically with respect to said pivoting point of said actuation body and insertable in said guiding tracks, recesses defined by said peaks at said opposite longitudinal edges of said guiding tracks, said pins having between one another a distance which is greater than the distance between two flanking peaks and smaller than twice the distance between said two flanking peaks so as to engage in said recesses.

* * * * *